US007238870B2

(12) United States Patent
Stewart

(10) Patent No.: US 7,238,870 B2
(45) Date of Patent: Jul. 3, 2007

(54) ENHANCED FRET SAVING DEVICE AND PROCESS

(76) Inventor: Shawn Dale Stewart, 351 E. Rosselien Pl., Apt. No. 8, Covina, CA (US) 91723

( * ) Notice: Subject to any disclaimer, the term of this patent is extended or adjusted under 35 U.S.C. 154(b) by 123 days.

(21) Appl. No.: 11/140,713

(22) Filed: May 31, 2005

(65) Prior Publication Data

US 2006/0266197 A1 Nov. 30, 2006

(51) Int. Cl.
*G10D 3/00* (2006.01)

(52) U.S. Cl. ..... 84/329

(58) Field of Classification Search ..... 84/329, 84/453, 297 S; 206/314
See application file for complete search history.

(56) References Cited

U.S. PATENT DOCUMENTS

| | | | | |
|---|---|---|---|---|
| 3,971,287 | A * | 7/1976 | Ito | 84/453 |
| 4,037,510 | A * | 7/1977 | Ginex et al. | 84/453 |
| 4,121,494 | A * | 10/1978 | Reno et al. | 84/453 |
| 4,528,889 | A * | 7/1985 | Gentile, Jr. | 84/453 |
| 4,753,147 | A * | 6/1988 | Berardi | 84/453 |
| 5,569,863 | A * | 10/1996 | Lem | 84/312 R |
| 6,172,292 | B1 * | 1/2001 | Dimbath | 84/453 |
| 6,262,354 | B1 * | 7/2001 | Solomon, Jr. | 84/329 |
| 7,102,073 | B1 * | 9/2006 | Isola | 84/723 |
| 2002/0189423 | A1 * | 12/2002 | Brantley | 84/453 |
| 2004/0139847 | A1 * | 7/2004 | Aiba | 84/722 |
| 2005/0066794 | A1 * | 3/2005 | Beerbohm | 84/453 |
| 2005/0145095 | A1 * | 7/2005 | Larry | 84/453 |
| 2005/0145096 | A1 * | 7/2005 | Kalousek | 84/453 |

* cited by examiner

*Primary Examiner*—Ross N. Gushi
(74) *Attorney, Agent, or Firm*—Greenberg Traurig, LLP; Peter Jon Gluck; Marlan D. Walker

(57) ABSTRACT

A specialized at least bilayered device similiformic with the fretboard/fingerboard/keyboard of an instrument is designed to be removingly disposed between the strings and fretboard or frets of the instrument and prevents or mitigates fret damages (from, for example, dimpling or string grooving) owing to string pressures—such as during transport and storage of the instrument in a case or other. Fret integrity and active or functional life is extended in an industrially efficient, economical and elegant way heretofore uncontemplated and/or commercially realized.

4 Claims, 4 Drawing Sheets

ENHANCED FRET SAVING DEVICE AND PROCESS

A portion of the disclosure of this patent document may contain material which may be subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE DISCLOSURE

The present disclosure relates to apparatus, devices and processes for maintaining the ongoing structural and mechanical integrity of stringed musical instruments, and others which are fretted or have fretboards.

In particular, the instant disclosure relates to mechanisms for increasing the functional lives of stringed, fretted and fretless instruments, such as guitars, including the Americanized version known as the electric guitar, and all others for which the instant disclosure is helpful, be they banjos, cellos, upright bases, any classical instruments or later developed apparatus.

FIELD OF THE DISCLOSURE

Since the dawn of recorded history, man's effort to have meaningful and entertaining usages of leisure time have included art, and what some have considered to be a sub-generic aspect of the same—music, which has, and continues to figure prominently in mythical, religious and many important other cultural practices and traditions. Hand in hand with this conceptual underpinning, new innovations have constantly been introduced which have advanced the practice of music, and provided broadened access to the same for the masses of people today coextensive with the consuming public. With these broadened horizons have come new needs.

Likewise, with the advent of the Internet, and exponential increases in memory capacity of various storage media, growth in the music business has continued to be important to those in commerce and industry. This is particularly true of the guitar itself, and the various things which have been created to improve the way the it sounds, how to make it sound like other audio effects, and to play it longer, louder and with repeatability of the sounds which can be achieved.

Characterized by some as paradigmatic of the evolution of manufacturing from craftsmanship to mass production (Millard, *The Electric Guitar, A History of an American Icon,* The Johns Hopkins University Press/Lemelson Center for the Study of Invention and Innovations, National Museum of American History, Smithsonian Institution, 2004) the electric guitar is among those specialized stringed or fretted instruments which are uniquely addressed by the instant teachings. According to current manufacturing processes and methods these instruments are made in improved and important ways related to the sounds which they produce to last longer, play better and require a lower degree of maintenance. The current disclosure is another aspect of this ongoing process of evolution.

However, like the long and checkered history of the first wooden stringed instruments themselves, the present disclosure is also integrally related to the travel, and/or transport of delicate instruments that has come to characterize the most popular and preferred instruments used by today's iconic players. At least about 2,500 years ago artwork attributed to the Hittites (who are said to have inhabited the land that is now known as Turkey) clearly was demonstrative of stringed instruments with fretted neck-like extensions. Music, by tapping into the human brain's pattern recognition capabilities, has always found a way to grow and expand its presence among civilized groups of people. As things need to be carted from place to place, the risk of damage to them increases, and delicate things become particularly susceptible to travel related harms and injuries. With popular items, risk management is sometimes an after-thought, and often subsequent remedial measures need to be taken when commercial growth runs ahead of the innovative cycle.

By way of further example, French Huguenots brought the guitar to the New World, and today there are approximately 700,000 of such units sold each year, domestically. This is commercially interesting, considering that like the Harley-Davidson® brand of motorcycle and the Zippo® brand of lighter, versions created fifty years ago are still being actively promoted, marketed and sold. In complement with newer versions, re-furbished or retrofitted classics and mass-produced less expensive models.

As later set forth in FIG. 5, guitars are played by the relative motion of strings and frets, those horizontal yet vertically elongated extended strips of material disposed along the neck of an instrument. These elements determine, in part, notes being played and/or intonation generally, as described in U.S. Letters Pat. No. 5,481,956 (expressly incorporated by reference as if fully set forth herein). As Pythagoras opined during the $6^{th}$ Century B.C., the equal-tempered scale bases the ratio of each successive semitone to the next on the twelfth root of two.

In other words, to artisans frets are the way to precisely divide the space along the neck of an instrument to divide the resulting sounds into two equal semitones. Since the twelfth root of two is equal to 1.05494631, mathematicians and instrument makers have used this higher order function to define the ratio of 1.0594631:1 for the basis to compute semitone intervals in equal-tempered tuning.

Logically progressing, the 'eighteen rule' means that using a ratio of 17:18 will maintain a tuned condition if a selected string length is divided into eighteen parts. This means that the distance from the saddle of the bridge to the first fret will equal seventeen parts. The distance from the first fret to the distal terminus will equal seventeen parts. If the distance from distal terminus to first fret is equal to $1/18^{th}$ of the string or scale length the pattern is denoued. This happens by dividing once again the remaining distance into eighteen parts, and $1/18^{th}$ of that distance will be the interval between the first and second frets. By continuing on for each fret the entire fretboard/keyboard/fingerboard is able to be precisely laid out. Musicians, for example, press strings selectively against frets to produce the various combinations that make up the scales and musical notes.

This is why the precise fret position and structural integrity is important, given that the next step is modulating the frequency of the vibration of sound waves reaching the ear (or perceived acoustical harmony/euphony by humans) is done by establishing a means for allowing each string to be adjustably compensated at the bridge saddle according to its length, tension, mass per unit length (diameter) and the material of which the string is composed. Music is created when selectively ordered progressions of notes are produced using those inherent characteristics of sound as created, amplified by and emerging from the instruments. A long standing and unrequited need exists to maintain the fretted aspects of the subject instrument pristine, as squarely addressed in the teachings of the present invention.

Since the present inventor has devoted considerable time and effort to researching and understanding the existence of any potential ways to approach the problem identified and solved by the advent of the instant teachings, it is respectfully proposed that none exist which are effective, durable, and available for commercial purposes, let alone effective to ameliorate fret travel and storage conditions, or mitigate potential deleterious impacts of the same as taught by the disclosure herein, and set forth in the figures and claims which are appended to the specification for which Letters Patent is respectfully requested. Accordingly, such relief is hereby earnestly solicited.

SUMMARY OF THE DISCLOSURE

Briefly stated, a specialized at least bilayered device similiformic with the fretboard/fingerboard/keyboard of an instrument is designed to be removingly disposed between the strings and frets or fretboard of the instrument and prevents or mitigates fret damages (from, for example, dimpling or string grooving) owing to string pressures—such as during transport and storage of the instrument in a case or while on a stand. Fret integrity and active or functional life is extended in an industrially efficient, economical and elegant way heretofore uncontemplated and/or commercially realized.

Likewise, those skilled in the art understand that for classical instruments, fretless instruments and those which do not have frets generally, the instant disclosure protects the fretboard area, or those aspects of the neck that lie directly underneath the strings—and for the purpose of this specification 'fretboard' is so defined, whether a fretless instrument or a classical instrument is involved.

Offered for consideration is an improved device for shielding the fretted neck portion of an instrument from string pressure which comprises, a two-sided construction similiformic with the shape of the involved instrument's neck, wherein a top side which abuttingly engages the strings has a stiff outer surface, and a bottom side further comprises a softer surface effective to cushion the underlying fret members from the mechanical forces of strings when compressed, bumped, bruised or otherwise negatively mechanically impacted.

Likewise disclosed is a fret-saver apparatus for extending the active life of an instrument by shielding fretted extensions disposed on the neck of the instrument from excessive pressure when not in use, comprising, in combination, an elongated detachable member having a top and a bottom face, having a distal end and a proximal end, further comprising a plasticized top face for engaging the strings of the instrument and a cushioned bottom face to shield the fretted extensions.

Similarly taught by the instant disclosure is a process for protecting the frets of a musical instrument which comprises, in combination, the steps of providing a kit, including a novel enhanced fret saving device, installing the device upon an instrument to be stored or transported and securing the same, and repeating the steps and/or removing the device.

BRIEF DESCRIPTION OF THE DRAWINGS OF THE DISCLOSURE

The above-mentioned features and objects of the present disclosure will become more apparent with reference to the following description taken in conjunction with the accompanying drawings wherein like reference numerals denote like elements and in which.

Figure 6A:
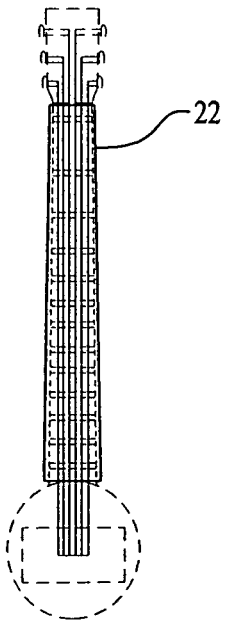
Figure 6B:
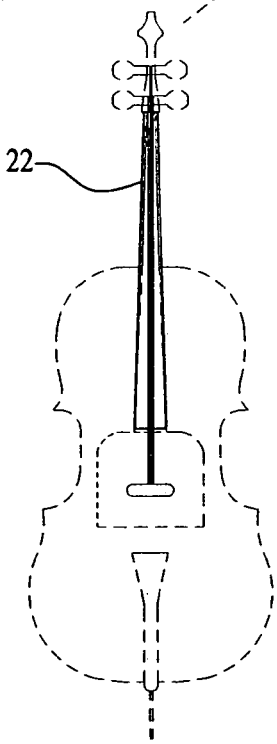
Figure 6C:
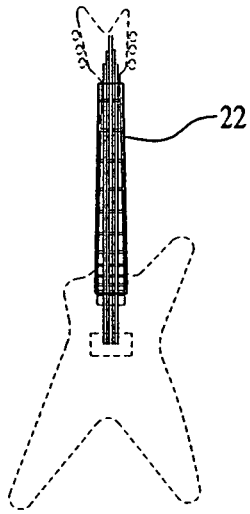

FIG. 6A, 6B and 6C each shows alternate configurations using the devices of the instant teachings, according to embodiments of the present disclosure.

DETAILED DESCRIPTION OF THE DISCLOSURE

For the purposes of the instant specification, 'fret' may be understood as it is defined in a conventional dictionary, namely as 'one of several ridges set across the fingerboard of a stringed instrument, such as a guitar' (AMERICAN HERITAGE DICTIONARY OF THE ENGLISH LANGUAGE, Third Edition, Houghton Mifflin Company, New York, 1999). As should become clear based upon the background referenced above, and the specification of the instant disclosure set forth below, it is respectfully proposed that the integrity of the frets is important for those wishing to produce similar sounding music over time.

Artisans realize that fret wires which are preferred in nickel/silver alloys come in various different configurations and hardness values. A conventional replacement, or 'fret job' is priced at greater than $200/US for a typical high-end guitar-type of instrument.

It is further respectfully submitted that the instant disclosure addresses and ameliorates longstanding and unrequited needs in this area, as many players are compelled to produce simulacrums of their past performances, often being compelled to use the same instruments to do so, and the present disclosure makes it possible to make this happen consistently over time without replacing the fretted aspects of subject instruments. Since this is not known commercially, anecdotally, or within any sector of the performing arts that has been explored, the same is believed to qualify as progress in science and the useful arts.

Classical musicians, and those who use fretless devices also benefit from the teachings of the present disclosure. Artisans will readily understand that attaching the device of the instant disclosure underneath of the frets is a measure easily taken with their instruments to protect them also from harm.

Figure 1:
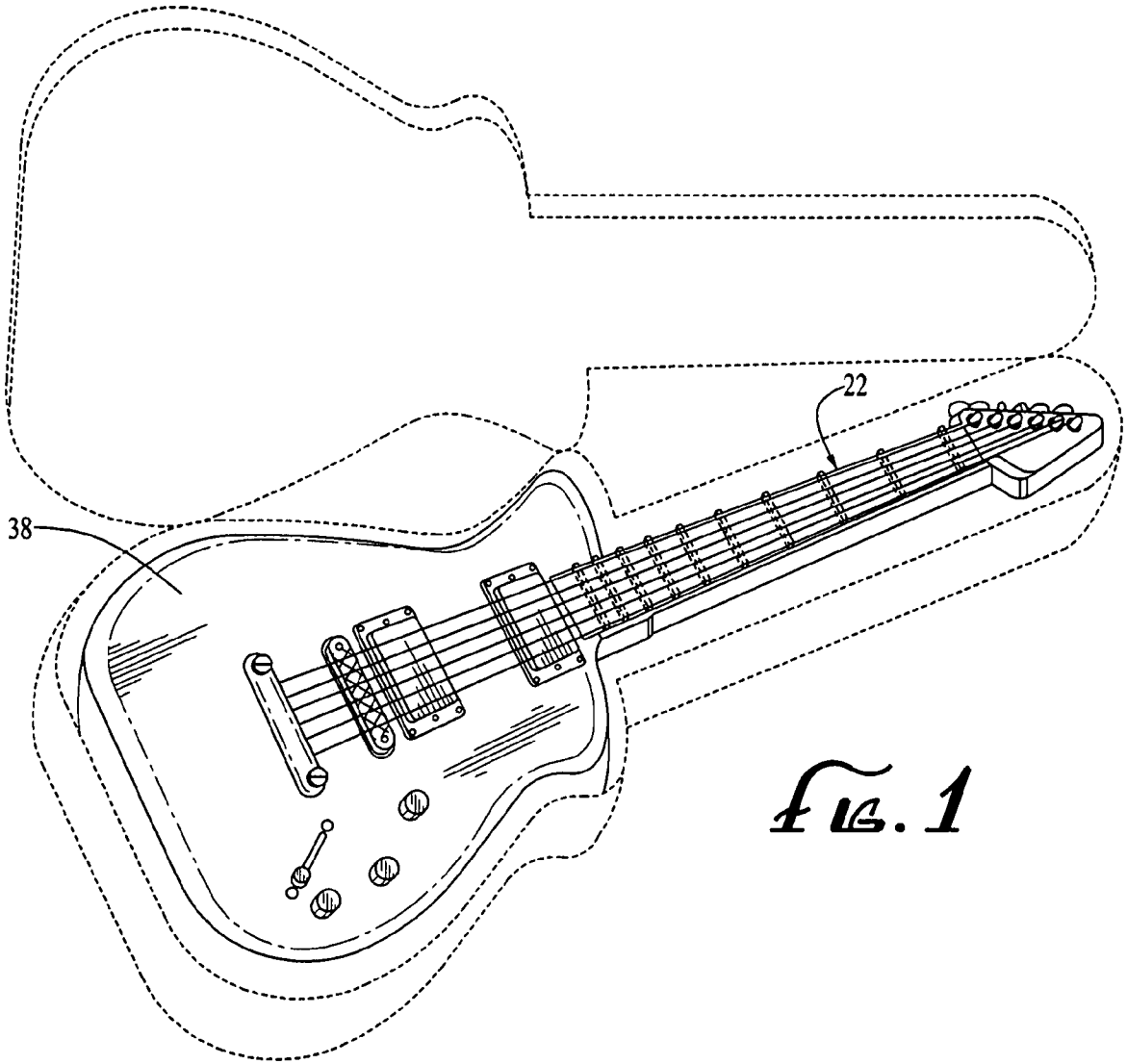
FIG. 1 is a schematic view of the present disclosure showing a basic configuration of an embodiment, when the subject instrument is being packed for travel.

The present inventor has discovered that the active functional life of the frets of any number of musical instruments is extendable by cushioning the impact of daily wear upon them. FIG. 1 shows device 22 attached to guitar 38 in a typical outline of a transport case. Pressures of being sandwiched into the case generally force the strings onto the frets, unless device 22 is present. Those skilled in the art will be readily aware of this phenomenon, while unaware of any long term ameliorator of the same.

Likewise, as discussed and defined above, generally protecting the fretboard for those instruments which are fretless or merely have an area defined by being underneath the strings is contemplated by the teachings of the instant disclosure.

By way of further example, U.S. Pat. No. 2,089,171—expressly incorporated herein as if fully set forth herein, for ELECTRICAL STRINGED MUSICAL INSTRUMENT shows a circular aspect which is the origin of at least half-of-a-dozen strings crossing between 18-27 fret-like members to an insertion site at a distal end (assuming one to be playing the same with a conventional strap—see FIG. 5, and FIG. 6A).

The present inventor cushions the impact of strings upon the frets when the subject instrument is not in play. At any time when a stringed musical instrument is not in play it is susceptible to injury, insult and attack by mechanical forces. Typically, stringed musical instruments reside on stands, and they fall down, are subject to things falling onto them, and without the teachings of the instant disclosure can become damaged. Whether on a stand or not, having a shielding member on the space underneath the frets is helpful to extend the active life of a stringed musical instrument.

Those skilled in the traveling musical arts realize hard-outer-shelled cases are usually supplied along with commercial instruments, and certainly generally employed with higher-end, classic and/or vintage models. These transport and storage cases, as opposed to protecting the delicate top surfaces of frets, often tend to compress the strings against them. It is estimated that the average guitar used, for example, by a traveling musician, requires several procedures per year to maintain the mechanical and structural integrity of the frets from the damage done by travel, storage and other transport related activities.

Added to the need for many in industry to produce precise simulacrums of their recorded performances each time that they play live, the state of the frets emerges as an important issue, and has been heretofore unaddressed by any known art. The present inventor has endeavored to uncover any and all commercial sources of the same, and conducted Internet and patent searching without any results. The sole means uncovered in the searching completed was a temporary cardboard, cloth or paper towel sometimes shipped with an initial purchase.

Referring again now to FIG. 1 and FIG. 2 a schematic shows an emplaced bilaminate construction of fret saving device 22, for example, of a durable vinyl/plastic/rubber 18 with a padded/cushioned layer/felt 17 on bottom side of device 22. Optional securement device 20 is shown for maintaining similiformic device 22 in a fixed position relative to the neck 21 of the desired stringed instrument 38.

Figure 2:
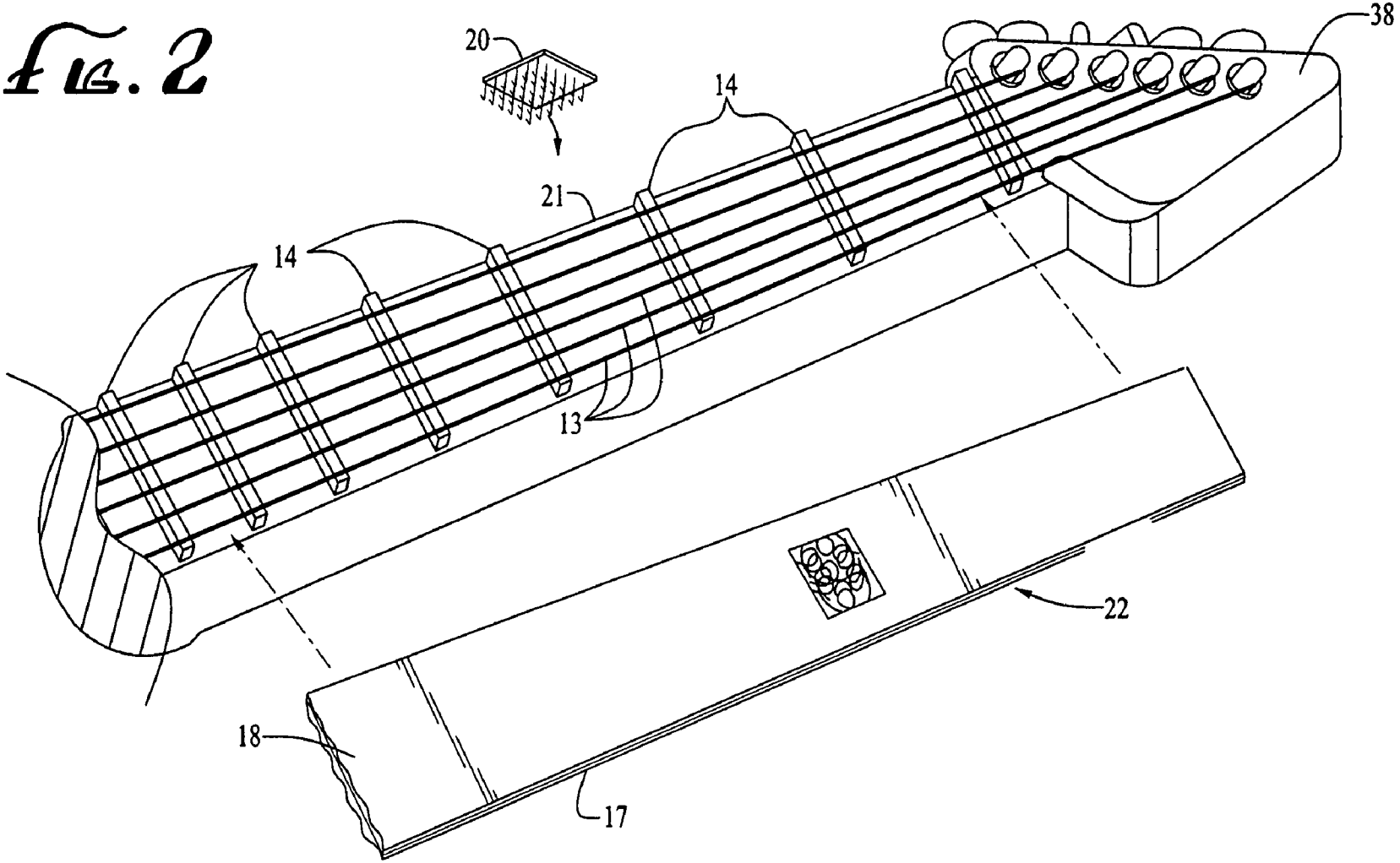
FIG. 2 is plan view according to embodiments of the present disclosure.

Securement device 20, has been manifested in several forms during the prototyping completed to date by the present inventor. Referring now to FIG. 2, a velcro® brand of closure strip is shown at a location between the two edges of device 22. Likewise, and also referring to FIG. 3, either strap mechanism 20 can bridge the strings 14 and attach directly to bottom layer 17 or alternate attachment strip 30 the strip can be wrapped around the back of the neck, then over the top of the neck, attaching to itself at the point of origination to a small square of the 'hook'-type velcro® brand fastener.

Likewise, for use with conventional acoustic and electric guitar typical size of prototypes of fret saver 22 have ranged between at least about 18 inches in length to over 24 inches, while width dimensions generally have ranged from at least about just under 2 inches to slightly more than 2.25 inches. Artisans will understand these to be exemplary and not limiting dimensions, and with reference to the instant specification and the claims which are appended hereto be able to extrapolate to the instrument of their choice. See also FIG. 6A, 6B and 6C.

Figure 3:
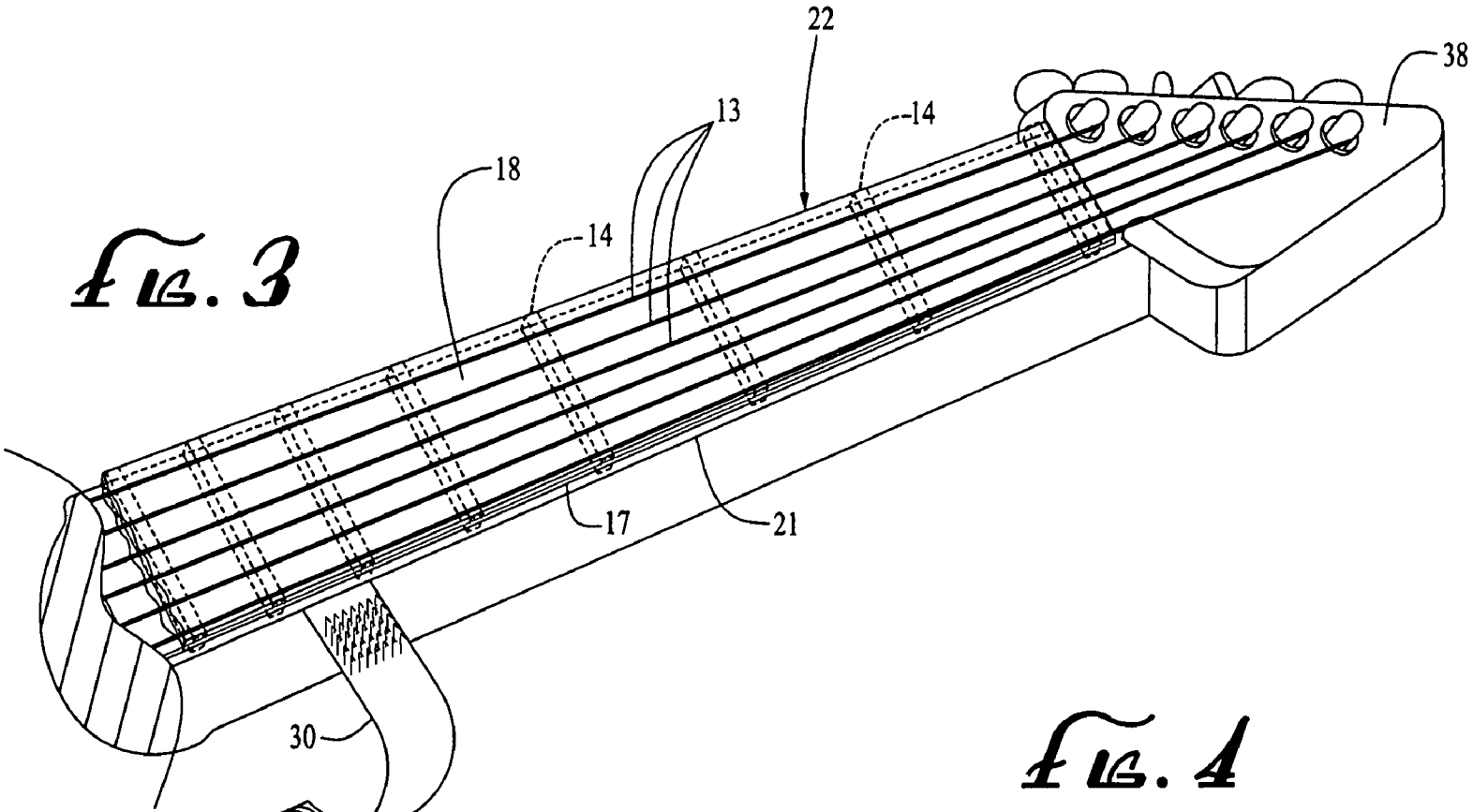
FIG. 3 is another plan view of an embodiment of the present disclosure showing how it may be attached to a typical stringed instrument.

Turning now to FIG. 3, fretted instrument neck similiformic device 22 is typically placed, or slid into place between the fretboard 21 of any stringed instrument 38 and bottom layer 17 shields the frets 14 from strings 13 which tend to make dimples, string grooves or related defects which are the result of excessive string pressure but for top layer 18 of device 22. As discussed above, attachment strip 30 can be wrapped around the back of the neck, then over the top of the neck, attaching to itself at the point of origination to a small square of the 'hook'-type velcro® brand fastener.

Figure 4:
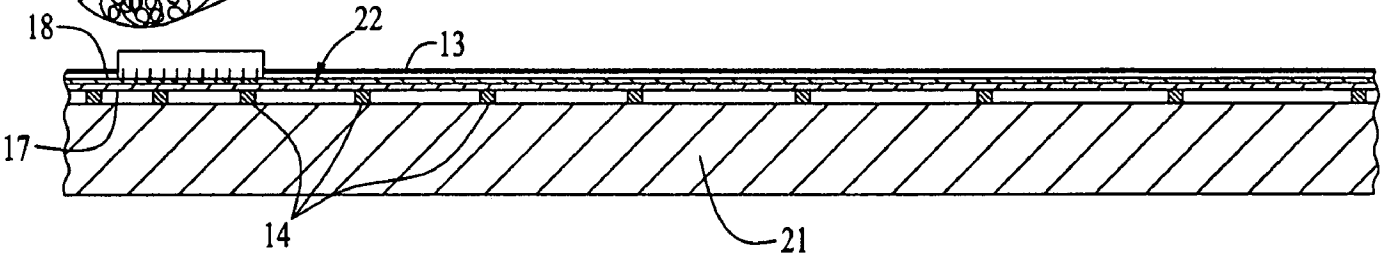
FIG. 4 shows a schematized side view of the present disclosure, including an alternative securing mechanisms as illustrated in FIG. 3.

FIG. 4 shows how attachment strip 30 the strip is wrapped around the back of the neck, then over the top of the neck, attaching to itself at the point of origination to a small square of the 'hook'-type velcro® brand fastener.

As discussed above, transport storage and other activities often place the frets 14 in jeopardy. Fretted instrument neck similiformic device 22 changes this by deflecting the mechanical force of each string 13 across its entire width dimension, as opposed to allowing the same to be concentrated upon a location upon any fret 14.

FIG. 4 shows a typical bilaminate construction with bottom/felt—like layer 17 abutting frets 14 and top/plastic—like layer 18 disposed against each string 13. Those skilled in the art realize that the only alternative for an instrument being transported, for example, in a hard-shelled-case (See FIG. 1) would be to loosen or to remove the strings, both of which are less attractive alternatives to the device of the present disclosure.

Figure 5:
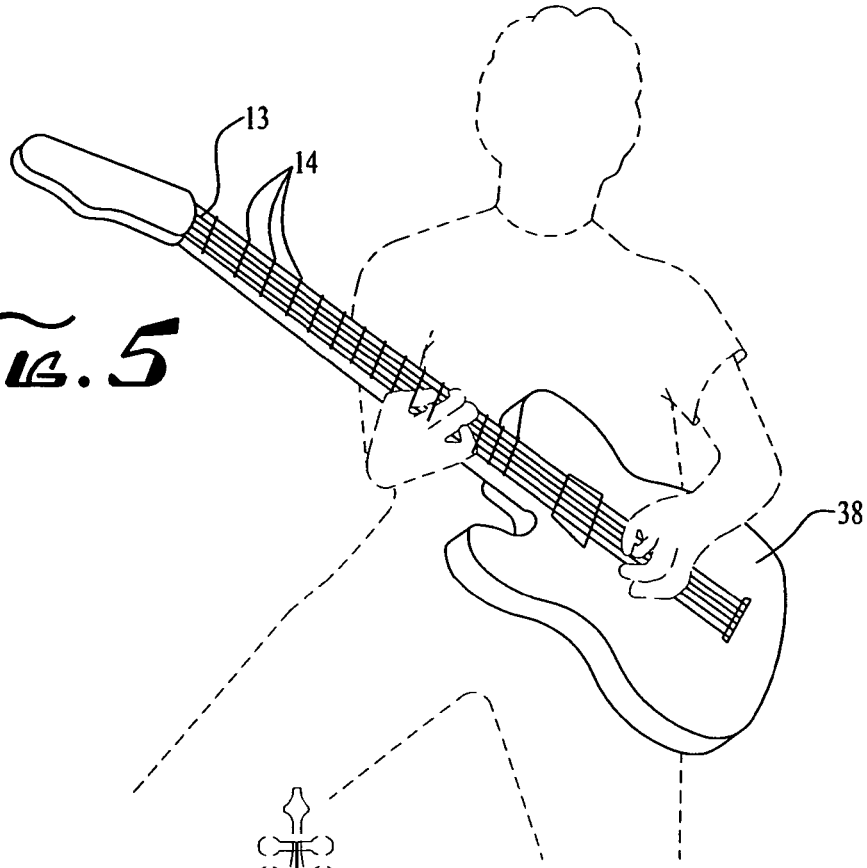
FIG. 5 shows a left-handed guitar player holding a guitar with a strap.

Referring now to FIG. 5, an electric guitar 38 is shown in use during a live performance. In the view shown the player is left-handed, meaning that the fingers of his right hand alternately depress selected strings 13, onto desired frets 14 to generate a desired progression of notes.

The left hand of the player shown plucks, strums and otherwise moves the strings of guitar 38, while the right hand slides along fretboard 21, and fingers hold, press or otherwise dispose a desired string 13, onto a desired fret 14. Essential to the ability to produce desired sounds is that the euphonic harmonized vibrations can be reproduced. It is respectfully proposed that since frets 14 will make different sounds in they have defective top surfaces, the object of the present disclosure 22 can improve the useful life of guitars 38, or any other fretted instruments by preserving their structural and mechanical integrity at all times except when they are being played.

FIG. 6A, 6B and 6C likewise show a variety of fretted instruments, 22 which are readily preserved with the use of the present invention 22. Those skilled in the musical arts will understand that the various dimensions of the fretboards of stringed instruments can be custom fitted by device 22, or universally sized. Likewise, as discussed classical and/or fretless instruments do not need to have frets to benefit from the instant teachings, as their respective fretboards areas are protected from injury, insult and the like.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. An improved device for shielding the neck portion of an instrument from damage while in use, comprising, in combination:

a two-sided construction, having a top face and a bottom face, of substantially similar shape and substantially similar size with the shape and size of the involved instrument's neck, the top side being plastic-based material and the bottom side is a felt-like material;

wherein a top side which abuttingly engages the strings has a stiff outer surface, and a bottom side further comprises a softer surface effective to cushion the underlying fretboard area from the mechanical forces of strings when compressed and related objects mechanically impacting on the fretboard area; and an attachment mechanism for detachingly engaging the device in a preferred orientation about the neck of a stringed instrument.

2. The device of claim 1, wherein the attachment mechanism is at least one member selected from the group consisting of velcro®-type of closure devices, straps and string.

3. A fret-saving apparatus for extending the active life of an instrument by shielding at least one of fretboards and fretted extensions disposed on the neck of the instrument from mechanical insult or injury when not in use, comprising, in combination:

an elongated detachable member having a top and a bottom face, and a distal end and a proximal end, the top face comprising a durable vinyl for engaging the strings of the instrument and a cushioned mylar and felt laminated construction bottom face to shield at least one of the fretboard and the fretted extensions; and a supplemental attachment mechanism to secure the elongated detachable member having a top and a bottom face to a desired location upon the neck of the instrument, the suplemental attachment mechanism comprising at least one member selected from the group consisting of velcro®-type of closure devices, straps, string, and a combination thereof.

4. The fret saving device of claim 1, wherein the laminated construction further include an in-laid velcro® portion which functions in conjunction with the supplemental attachment mechanism.

* * * * *